US005878614A

United States Patent [19]

Okamoto

[11] Patent Number: 5,878,614

[45] **Date of Patent: *Mar. 9, 1999**

[54] FINN PASS FORMING DEVICE FOR FORMING SEAM WELDED STEEL PIPES AND ROLLER DEVICE AVAILABLE FOR FORMING SEAM WELDED STEEL PIPES OF A PLURALITY OF SIZES

[75] Inventor: Atsumu Okamoto, Kawanishi, Japan

[73] Assignee: Nakata Manufacturing Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 793,288

[22] PCT Filed: Apr. 12, 1996

[86] PCT No.: PCT/JP96/01026

§ 371 Date: Mar. 10, 1997

§ 102(e) Date: Mar. 10, 1997

[87] PCT Pub. No.: WO97/03771

PCT Pub. Date: Feb. 6, 1997

[30] Foreign Application Priority Data

Jul. 19, 1995 [JP] Japan ..... 7-183055
Feb. 23, 1996 [JP] Japan ..... 8-036155

[51] Int. Cl.[6] ..... B21D 39/02; B21D 51/28; B21D 5/08; B21D 5/14

[52] U.S. Cl. ..... 72/52; 72/178; 72/182

[58] Field of Search ..... 72/51, 52, 178, 72/182, 181, 224, 225; 228/17, 17.5, 147, 151

[56] References Cited

U.S. PATENT DOCUMENTS 4,122,696 10/1978 Midzutani et al. ..... 72/52
5,016,459 5/1991 Kuramoto ..... 72/52

FOREIGN PATENT DOCUMENTS 53-64654 11/1976 Japan .
53-88651 1/1977 Japan .
63-268512 2/1987 Japan .

*Primary Examiner*—Joseph J. Hail, III
*Assistant Examiner*—Rodney Butler
*Attorney, Agent, or Firm*—Kenyon & Kenyon

[57] ABSTRACT

In the fin pass forming apparatus, the fin roller is split in two symmetrically with respect to the center line of the flow direction of a steel pipe to be formed, and a plurality of side rollers are arranged on a section perpendicular to the flow direction of the steel pipe. At least one fin roller stand is mixed in a group of roller stands including a cluster mill composed of a lower roller and a plurality of pairs of side rollers. The fin roller arranged in the cluster mill is split in two, one is a roller on the work side and the other is a roller on the drive side. The split fin rollers come into contact with a steel pipe to be formed at arbitrary positions in arbitrary directions in the circumferential direction of the steel pipe to be formed so as to conduct a fin pass formation. The plurality of fin pass forming rollers are arranged on a section different from the flow direction of the steel pipe to be formed.

5 Claims, 9 Drawing Sheets

FINN PASS FORMING DEVICE FOR FORMING SEAM WELDED STEEL PIPES AND ROLLER DEVICE AVAILABLE FOR FORMING SEAM WELDED STEEL PIPES OF A PLURALITY OF SIZES

TECHNICAL FIELD

The present invention relates to a forming device for forming seam welded steel pipes into which fin pass rollers are incorporated to form both edge portions of the seam welded steel pipes before welding.

The present invention relates to a roller device of a pipe mill available for forming seam welded steel pipes of a plurality of sizes in which a cluster mill and a fin pass mill are mixedly arranged on the same line so as to conduct elliptical forming and edge forming simultaneously before welding.

BACKGROUND ART

In general, the roller stands of a seam welded steel pipe manufacturing line is arranged as follows. As illustrated in FIG. 1, the seam welded steel pipe manufacturing line includes: a breakdown section (BD section: 1) in which bending operation conducted on a strip is started; a fin pass forming section (FP section: 2) in which the strip edges are formed into predetermined shapes and the strip is guided into a welding section; a welding section (WA section: 3); and a shape straightening section (SZ section: 4). In the above arrangement, the fin pass forming section 2 is comprised of horizontal and vertical rollers arranged in 3 to 4 stages of roller stands at the end of forming before welding. By the action of a fin plate attached to the vertical roller, the fin roller moves between both edge portions of a strip to be formed and conducts angle-controlling, finish-forming and centering so that both edge portions can be stably formed into predetermined shapes.

As illustrated in FIGS. 2(*a*) and 2(*b*), each fin pass forming stand includes: an upper roller 6 having a fin 7 at its center; a lower roller 8 having no fin; and/or side rollers (horizontal rollers) 9. Radiuses of curvature of these rollers and the width of the fin are determined by the outer diameter of the steel pipe 10 to be formed in this manufacturing process. Therefore, according to the conventional fin pass forming method, when the edge portions of a strip are pressed against the fin of the upper roller by the actions of two rollers including an upper and a lower roller, or by the actions of four rollers including an upper, a lower, a right and a left roller, a force for forming is given to the strip in the circumferential direction, so that the edge forming can be conducted while a relatively high reduction is being given to the strip. In the normal operation, the reduction is approximately 1 to 2% in total with respect to all fin pass stands. Usually, a caliber roller is used for the fin pass roller because reduction can be easily given to the strip by the caliber roller.

Therefore, in the case where seam welded steel pipes of a plurality of sizes are formed on one manufacturing line, it is necessary to provide a plurality of sets of rollers, the number of which corresponds to the number of sizes of seam welded steel pipes to be formed. Further, when the size of a seam welded steel pipe to be formed is changed, it takes time to replace the rollers. Furthermore, it is necessary to replace the rollers frequently.

In the field of manufacturing seam welded steel pipes, in accordance with the progress of development of peripheral technology such as technology of manufacturing materials and technology of processing, there are increasing demands for enhancing the accuracy of products, producing a small amount of products of a large number of grades, reducing the number of workers on the production line and automatizing the production line. In order to meet the above demands, it is desired to apply one roller device to seam welded steel pipes of a plurality of sizes. Also, it is desired to ensure a stable welding condition in the welding process by improving the forming method of seam welded steel pipes.

Concerning the fin pass forming, various techniques have been developed so as to satisfy the above demands, however, the development is limited to improvements in the shape of the fin. An example of improvements in the shape of the fin is disclosed in Japanese Unexamined Patent Publication No. 5-277567, which will be described as follows. Instead of a shape of the conventional upper roller having a fin, a special shape of the roller, which is formed into a fin-plate shape, is adopted. There are arranged upper rollers so that they can be respectively tilted and rotated on both sides of this fin plate. In accordance with the state of the upper rollers which are tilted and rotated, only linear or curved caliber surfaces of the fin plate are contacted with both edge portions of the strip to be welded. Therefore, the shapes of both edge portions of the strip can be easily changed in the process of forming, and the welding condition can be changed in accordance with the shape of both edge portions of the strip.

Japanese Unexamined Patent Publication No. 3-169432 discloses the following forming method. In order to bend the edge portions of a strip sufficiently so as to form the edge portions into predetermined shapes and increase the thickness of the edge portions while utilizing the strong drawing effect in the front stage of the fin pass rollers, fin pass forming is conducted by the front two fin pass roller stands, and the thus formed shape is maintained by the residual roller stands in the rear stage so as to weld and convey the edge portions. Due to the foregoing, all the residual roller stands in the rear stage are made to be available for forming seam welded steel pipes of a plurality of sizes.

However, all the above techniques have the following problems. According to the conventional fin pass rolling method, the number of roller stands is 3 to 4, and in each roller stand, the rollers are arranged at the upper and the lower position, or alternatively they are arranged at the upper, the lower, the right and the left position. On the upstream side of the fin pass rollers, there are provided side rollers so as to conduct an auxiliary fin pass rolling. Therefore, rollers in each roller stand must be set for each size of the steel pipe to be formed. Further, in the case of replacing the rollers, it is necessary to adopt a cassette system roller replacing method by which the rollers in each roller stand are replaced or the rollers in a plurality of roller stands are replaced simultaneously.

Further, the following problems may be encountered. According to the conventional steel pipe forming method, edge bending can not be controlled sufficiently in the breakdown pass of the front stage. Accordingly, it is necessary to give a large amount of reduction in the fin pass rolling process so as to make up for edge bending. Accordingly, it is impossible to avoid the deformation of a steel pipe to be formed in the process of fin pass forming, so that the roundness of the steel pipe to be formed can not be ensured.

From the viewpoint of recent tendency of the production system in which a small quantity of products of a large number of grades are produced and production is carried out without having stock, the roller replacing operation described above takes time and labor, so that the productivity is greatly deteriorated.

Conventionally, seam welded steel pipes are produced as follows. A strip to be formed is subjected to edge forming in the breakdown process. Then the strip is subjected to elliptical forming by the cluster mill. After that, in the fin pass rolling process, angles of the edge surfaces are controlled by the fin rollers, and finish rolling and centering are conducted. After an amount of upset necessary for welding is adjusted by the squeeze rollers, welding is conducted on the edge portions. In the sizing process, the thus formed steel pipe is straightened, and the pipe is finished to a final product. In the above producing process, the cluster process and the fin pass rolling process are usually conducted by different roller stands. The reason is described as follows. In the process of deformation in the thickness direction of a strip to be formed, on the external surface of the strip, tension/compression is given, and on the internal surface, compression is given. Accordingly, different roller stands must be provided in accordance with the states of deformation conducted on the strip. Therefore, rollers must be replaced for each product size, and further a plurality of roller stands must be prepared for replacing the roller stands. Furthermore, it takes time and labor to replace the roller stands. In addition to that, the equipment investment is doubled.

Calibers of the conventional cluster rollers available for forming seam welded steel pipes of a plurality of sizes are designed so that they can be applied to the seam welded steel pipes of large and small sizes. Therefore, the section of the cluster roller is formed from an involute based on a polygon capable of being applied to various pipe sizes, and when the cluster roller is turned, it can be applied to seam welded steel pipes of a plurality of sizes. Due to the foregoing, when the pipe size is changed, it is natural that a contact position of the strip with the roller caliber is changed, especially it is natural that a contact position of the edge with the roller is changed. For this reason, it has been considered that it is impossible to provide a shoulder stop of the edge portion of the strip to be formed, that is, it has been considered that it is impossible to provide a fin roller. Accordingly, from the recognition that the cluster rolling process and the fin pass rolling process must be provided being separate from each other, they are arranged as different apparatus. Therefore, the aforementioned problems have not been solved yet.

BRIEF DESCRIPTION OF THE DRAWINGS

FIG. 2(*a*) represents a view showing the two-roller type fin pass forming rollers used for forming seam welded steel pipes of small sizes, and FIG. 2(*b*) represents a view showing the four-roller type fin pass forming rollers used for forming seam welded steel pipes of large sizes.

FIG. 5(*a*) represents a side roller driving device used for forming a steel pipe of a large diameter, and FIG. 5(*b*) represents a side roller driving device used for forming a steel pipe of a small diameter.

SUMMARY OF THE INVENTION

Figure 1:
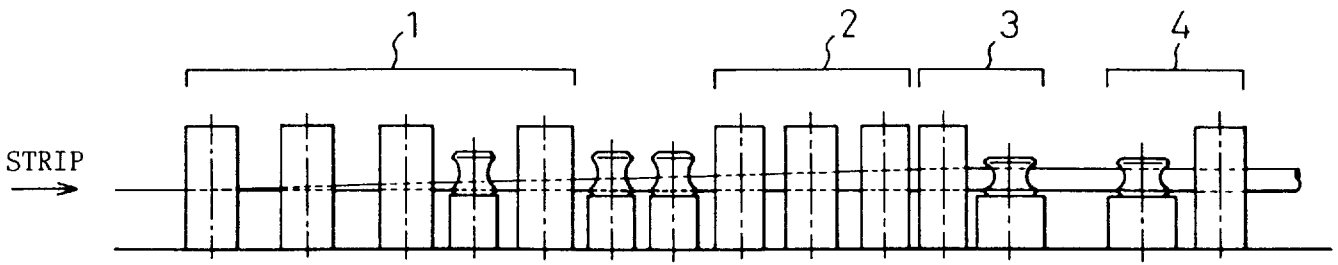
FIG. 1 PRIOR ART
FIG. 1 is a schematic illustration showing a conventional producing apparatus for producing seam welded steel pipes.
Figure 2A:
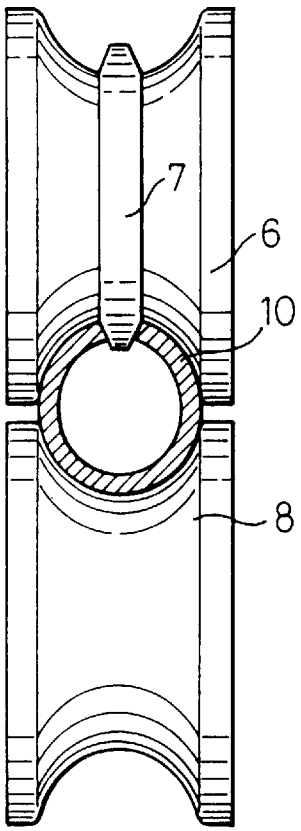
FIG. 2(a) PRIOR ART
FIG. 2 is a view showing conventional fin pass forming rollers.
Figure 2B:
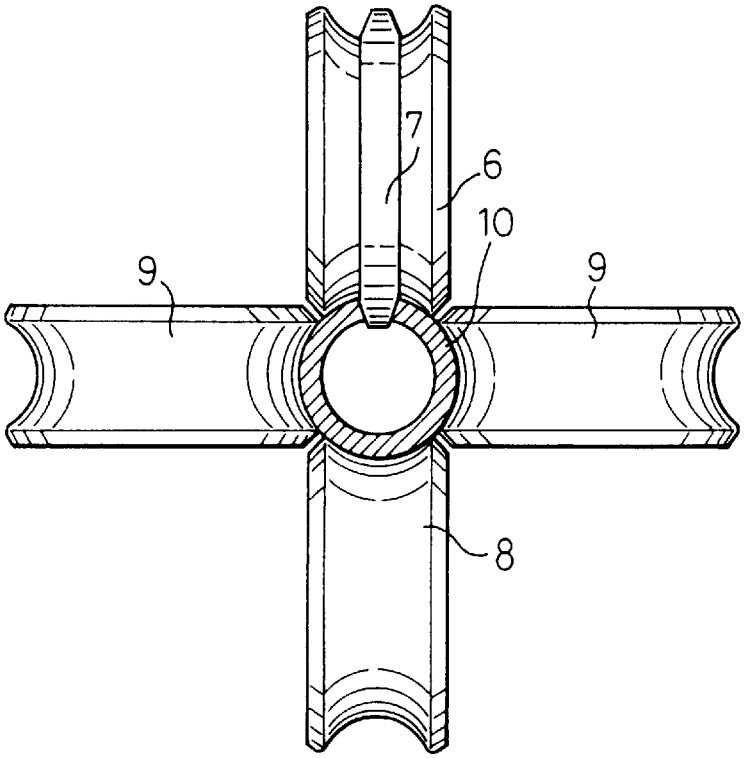
FIG. 2(b) PRIOR ART

The present inventors applied for a patent, which was disclosed in Japanese Examined Patent Publication Nos. 3-12975 to 12977, the summary of which will be described as follows. A portion or all of the sectional curve of each roller surface of the breakdown roller is composed of an involute that has been previously determined to contain each curved surface of a predetermined portion of a strip to be formed into steel pipes of various outer diameters, and the edge portions of the strip are formed by the thus composed rollers.

In accordance with the technique disclosed in the above patent application, the present inventors have made investigation into the problems caused in the fin pass forming process and also into the fin pass forming apparatus in earnest. As a result of the investigation, the present inventors have discovered the following. When the structure of the fin rollers and the arrangement of the fin pass rollers including the fin rollers are changed in the fin pass forming apparatus, and also when the radius of curvature of the surface of each roller is formed from a sectional curve composed of a predetermined involute, it is possible to provide a roller device available for forming seam welded steel pipes of a plurality of sizes, and at the same time it is possible to reduce a load given to the fin pass rollers in the process of fin pass forming. Further, even if an amount of reduction is very small, for example, even if an amount of reduction is approximately 1%, it is possible to obtain a highly accurate roundness. The inventors have succeeded in discovering the aforementioned efficient fin pass forming apparatus.

The present invention is to provide a roller device used for a pipe mill available for forming seam welded steel pipes of a plurality of sizes in which the elliptical forming and the edge forming are simultaneously conducted by the cluster mill and the fin pass mill which are arranged in the same apparatus after the breakdown process to conduct edge bending on the strip to be formed.

The present invention has been accomplished according to the above knowledge.

(1) The present invention is to provide a fin pass forming apparatus for forming seam welded steel pipes comprising: a pair of fin rollers split into the work and the drive side; a plurality of pairs of side rollers coming into contact with a steel pipe to be formed, in arbitrary directions or at arbitrary positions in the circumferential direction of the steel pipe to be formed, the side rollers being capable of conducting fin pass forming; and at least one lower roller for supporting and forming the steel pipe to be formed, wherein the fin rollers and the plurality of rollers are respectively arranged on each section perpendicular to the flow direction of the steel pipe to be formed, and each of the pair of fin rollers is arranged being inclined with respect to a line perpendicular to the flow direction of the steel pipe to be formed.

(2) The present invention is to provide a fin pass forming apparatus for forming seam welded steel pipes in which the section of the surface of each of a plurality of rollers including the fin rollers and the lower roller is formed in such a manner that a portion or all of the sectional curve of each roller surface is formed from a sectional curve composed of an involute previously determined so that the involute includes each curved surface of the steel pipes to be formed of various outer diameters in the forming region concerned.

(3) The present invention is to provide a train of fin pass forming devices. In the fin pass roller group composed in the manner described above, a single roller stand of the fin pass forming device includes: a pair of fin rollers; a lower roller arranged on a section at the center of the fin roller shaft; and not less than one pair of side rollers arranged before and after the fin roller section, wherein the train of the fin pass forming devices includes at least one roller stand concerned.

(4) The present invention is to provide a roller device available for forming seam welded steel pipes of a plurality of sizes comprising a cluster mill composed of a plurality of pairs of side rollers and a plurality of lower rollers, wherein at least one roller stand having fin rollers is arranged in a group of roller stands having the plurality of pairs of side rollers.

(5) The present invention is to provide a roller device available for forming seam welded steel pipes of a plurality of sizes comprising a cluster mill composed of a plurality of pairs of side rollers and a plurality of lower rollers, wherein at least one roller stand having fin rollers is arranged in a group of roller stands having the plurality of pairs of side rollers, and the fin rollers arranged in the cluster mill including: a pair of fin rollers split into the work and the drive side with respect to the forming direction of a steel pipe to be formed; a plurality of pairs of side rollers coming into contact with the steel pipe to be formed, in arbitrary directions or at arbitrary positions in the circumferential direction of the steel pipe to be formed, the plurality of pairs of side rollers being capable of conducting fin pass forming; at least one lower roller for supporting and forming the steel pipe to be formed, wherein the fin rollers and the plurality of pairs of side rollers are respectively arranged on each section perpendicular to the forming direction of the steel pipe to be formed, and each of the pair of fin rollers is arranged being inclined with respect to a line perpendicular to the forming direction of the steel pipe to be formed.

(6) The present invention is to provide a roller device available for forming seam welded steel pipes of a plurality of sizes according to one of items (1) to (5), wherein the fin portions of the pair of fin rollers are put on the front end portions of the side rollers so as to form a recess portion capable of conducting an elliptical forming of the edge portions and the front end portions of the steel pipe to be formed.

THE MOST PREFERRED EMBODIMENT

In the fin pass roller of the present invention, the fin roller is symmetrically split into two portions with respect to a perpendicular line along the flow direction of a steel pipe to be formed. One portion of the fin roller is arranged on the work side, and the other portion is arranged on the drive side. Further, the fin roller is inclined with respect to the perpendicular line. The pair of fin rollers split in the above manner comes into contact with arbitrary portions of the edges on both sides with respect to the width direction of a steel pipe to be formed, so that the edges can be processed by the fin rollers. The position of each fin roller arranged in the above manner can be freely adjusted in the vertical and the transverse direction when an L-shaped fin roller support member connected to the fin roller shaft and a platform to hold the fin roller support member are oscillated. Due to the above arrangement, the pair of fin rollers can be contacted with arbitrary positions in the circumferential direction of the edges on both sides of the steel pipe to be formed in the pipe width direction, so that the edges on both sides can be formed into predetermined shapes. In the fin pass forming of the present invention, the edges of the steel pipe to be formed are contacted with the fin portions of the fin rollers in the forming process at all times.

On the other hand, immediately below the pair of fin rollers and the steel pipe to be formed, there is provided a lower roller, which supports the steel pipe to be formed from the lower side.

Side rollers of the device of the present invention are arranged on a section perpendicular to the pipe flow direction which is different from the section on which the fin rollers are arranged. Accordingly, it is possible to form a steel pipe at an arbitrary position in an arbitrary direction in the circumferential direction of the steel pipe to be formed.

In the present invention, the sectional shape of the surface of each roller in the roller group including the fin rollers, lower rollers and side rollers is composed of a sectional curve of an involute which is previously determined so that a portion or all of the sectional curve of the surface of each roller can contain a curved surface of a predetermined portion of the steel pipe to be formed of various outer diameters in the forming region concerned. Therefore, the surface of each roller is designed so that all curved surfaces necessary for forming can be contained when the radius of curvature of the roller surface is continuously changed. For example, in the cases of fin rollers and side rollers, the radius of curvature is made to be large in a portion from the lower side to the upper side of the roller. Accordingly, in the case of forming a large diameter steel pipe, a curved surface on the lower side of the roller, the radius of curvature of which is small, is exclusively applied, and in the case of forming a small diameter steel pipe, a curved surface on the upper side of the roller, the radius of curvature of which is large, is exclusively applied. The shape of the roller surface is composed in the above manner. The shape of the lower roller is designed in such a manner that the radius of curvature is reduced as it comes from the lower side to the upper side of the roller. As described above, it is possible for each roller in the device of the present invention, although the shape of which is limited to one type, to form steel pipes of various diameters. Therefore, it is unnecessary to replace a forming roller stand each time the diameter of a steel pipe to be formed is changed. As a result, the productivity of fin pass forming can be greatly enhanced.

In the fin pass forming apparatus of the present invention, as described above, a single roller stand in the fin pass roller group includes: a pair of fin rollers; a lower roller arranged at the lower position of a steel pipe to be formed which comes into contact with the fin rollers; and not less than one pair of side rollers arranged before and after the fin rollers, and the train of the fin pass forming devices includes at least one roller stand concerned. For this reason, it is possible to replace one set of conventional fin pass forming stands with a single roller stand composed of a group of at least seven rollers. Since the train of fin pass forming devices of the present invention has the above excellent property, the overall length of the apparatus can be reduced, and the equipment investment can be reduced.

In the roller device of a pipe mill available for forming seam welded steel pipes of a plurality of sizes, a strip to be formed into a steel pipe is subjected to edge forming by a cluster mill usually composed of 6 to 8 roller stands, so that the edge portions can be formed. Immediately after the formation of the edges, or in parallel with that, elliptical formation is started, in which the central portion of the steel pipe is also formed. In the cluster mill, elliptical formation is performed by a pair of side rollers arranged in the traverse direction or alternatively, elliptical formation is performed by the side rollers and the lower roller combined with the side rollers. At appropriate positions in the series of cluster mills, the fin pass rollers are arranged, for example, one stand of the fin pass rollers are arranged in the first half, and the other stand of the fin pass rollers are arranged in the middle stage or alternatively in the latter half. That is, 2 or 3 fin pass roller stands are arranged in the appropriate positions. In this case, the fin pass roller stands may be arranged singly or together with the side rollers at the same position. In this way, the fin pass formation is performed simultaneously with the elliptical formation. Alternatively, only the fin pass formation is performed successively after the elliptical formation. Of course, it is preferable that the fin pass roller are arranged at the same positions as those of the side rollers and the fin pass formation is performed simultaneously with the elliptical formation.

In the above case, the fin pass rollers are arranged as follows. The fin roller is symmetrically split into two portions with respect to the flow direction of a steel pipe to be formed, wherein one is a portion arranged on the work side and the other is a portion arranged on the dive side. In the circumferential direction, the pair of fin rollers that have been split in the above manner come into contact with the edges on both sides of the steel pipe to be formed in the width direction at arbitrary positions in arbitrary directions when the steel pipe to be formed is conveyed in the longitudinal direction. In order to form the edge portions in the above arrangement, the pair of fin rollers are inclined on a section different from the flow direction of the steel pipe to be formed, and arranged at the same positions as those of the side rollers. Accordingly, it is possible to simultaneously perform both the elliptical formation and the edge formation.

In the process of forming, this fin roller can be freely adjusted in the vertical and the traverse direction by an arm moving device and a drive source via an arm connected to the fin roller shaft. Therefore, in the circumferential direction of the steel pipe to be formed, the fin rollers are capable of coming into contact with the edge portions on both sides of the steel pipe at arbitrary positions in arbitrary directions, so that the edge portions can be formed into predetermined shapes. The lower roller is arranged immediately below the pair of fin rollers and the steel pipe to be formed. Therefore, the lower roller holds a lower portion of the steel pipe to be formed in the process of forming.

In the present invention, the sectional shape of the surface of each roller in the roller group including the fin rollers is composed of a sectional curve of an involute which is previously determined so that a portion or all of the sectional curve of the surface of each roller can contain a curved surface of a predetermined portion of the steel pipe to be formed of various outer diameters in the forming region concerned. Therefore, the surface of each roller is designed so that all curved surfaces necessary for forming can be contained when the radius of curvature of the roller surface is continuously changed, and the radius of curvature of each roller is designed to be large in a portion of the roller from the lower to the upper side. Consequently, in the formation of a large diameter steel pipe, a portion on the upper side of the roller, the radius of curvature of which is small, is exclusively applied, and in the formation of a small diameter steel pipe, a portion on the lower side of the roller, the radius of curvature of which is large, is exclusively applied. As described above, it is possible for each roller in the device of the present invention, although the shape of which is limited to one type, to form steel pipes of various diameters. Therefore, it is unnecessary to replace a forming roller stand each time the diameter of a steel pipe to be formed is changed. As a result, the productivity of fin pass forming can be greatly enhanced.

As described above, in the roller device of the pipe mill of the present invention available for forming seam welded steel pipes of a plurality of sizes in which the cluster mill and the fin pass mill are combined, it is possible to perform both the elliptical formation and the fin pass formation simultaneously by the same apparatus arranged on the same line. Therefore, it is unnecessary to arrange the cluster mill and the fin pass mill separately and to conduct the operations separately from each other. Further, it is unnecessary to provide a train of fin pass forming devices, the overall length of the apparatus can be shortened, and the equipment investment can be extremely reduced.

EXAMPLES

Example 1

Referring to the accompanying drawings, the present invention will be explained below.

Figure 3:
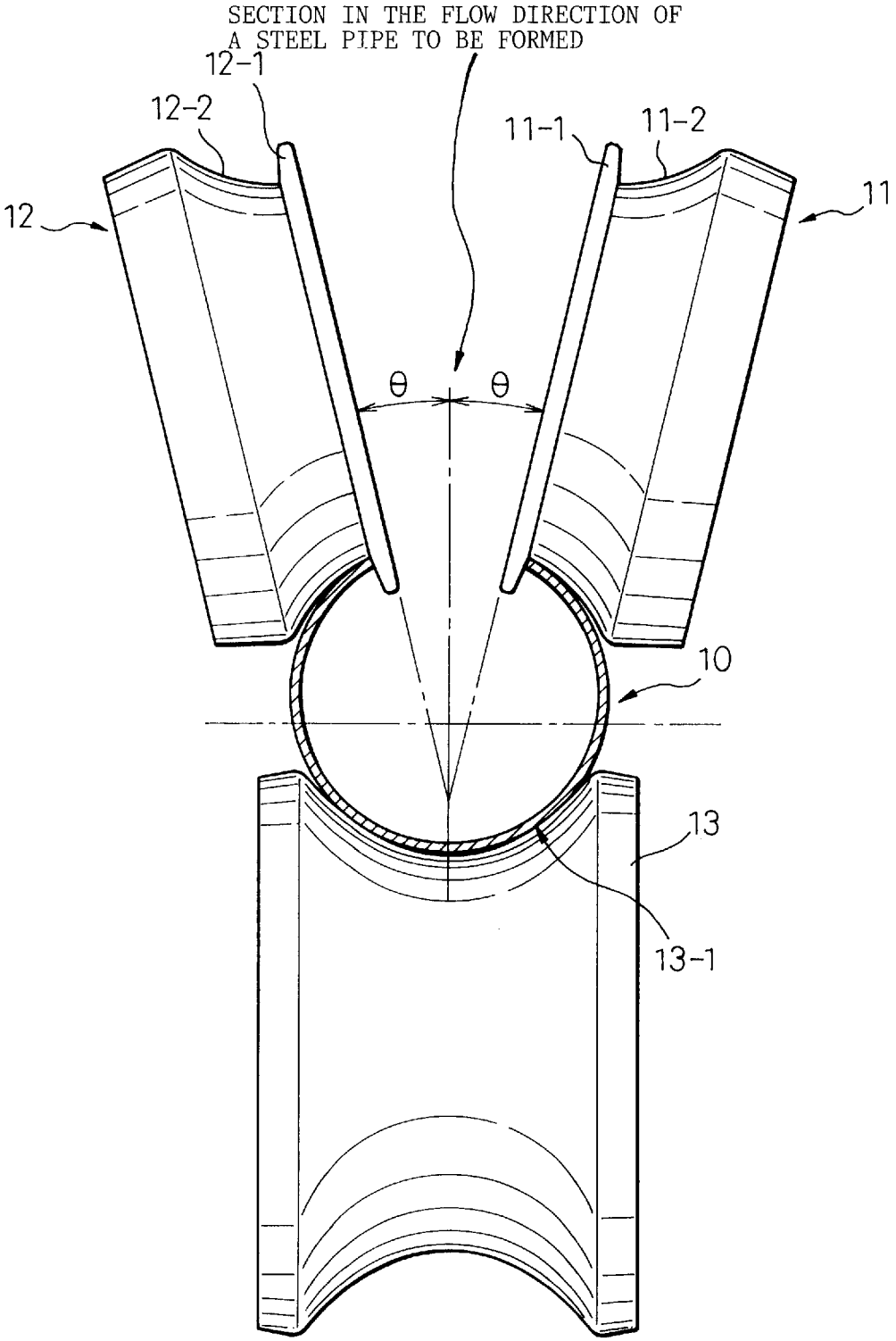
FIG. 3 is a front view showing an arrangement of the fin pass forming rollers of the present invention.

FIG. 3 is a front view of the fin pass forming stand of the fin pass forming device of the present invention. As illustrated in FIG. 3, the fin roller used in the device of the present invention is split into two portions, that is, one is a fin roller 11 on the work side, and the other is a fin roller 12 on the drive side. The fin roller of the present invention is made as if a conventional fin roller were split into two rollers in the flow direction of the steel pipe 10 to be formed when the view is taken from the front side. The thus obtained two rollers are symmetrically arranged with respect to a line perpendicular to the flow direction of the steel pipe 10 to be formed. On the innermost sides of the respective fin rollers, there are provided fins 11-1 and 12-1. The above fin rollers are arranged being inclined by an angle θ° with respect to a line perpendicular to the flow direction of the steel pipe to be formed. Positions of these fin rollers can be adjusted in the vertical and the transverse direction with respect to the center of the steel pipe by a platform position adjusting mechanism described later. Accordingly, when the steel pipe to be formed is conveyed in the longitudinal direction, these fin rollers are capable of coming into contact with arbitrary positions of the edges on both sides of the steel pipe in the pipe width direction. When the fin rollers are contacted with the edge portions of the steel pipe to be formed, it is possible to form the edge portions.

On the other hand, immediately below the steel pipe 10 to be formed and the pair of fin rollers, there is provided a lower roller 13 for holding and forming the steel pipe 10 to be formed. This lower roller 13 performs a forming work together with the aforementioned fin rollers.

A radius of curvature of each roller surface 11-2, 12-2, 13-1 of the pair of fin rollers 11, 12 and the lower roller 13 is determined in such a manner that a portion or all of the sectional curve of the surface is composed of an involute previously determined so that it can contain a predetermined curved surface of the strip to be formed into a steel pipe of various outer diameters in the forming region. In this case, the radius of curvature of the surface is designed to contain all curved surfaces necessary for the formation of steel pipes, and the radius of curvature is also designed to increase as it comes from the lower side to the upper side of the roller. Accordingly, irrespective of the size of the steel pipe to be formed, it is possible to freely select a radius of curvature of the curved surface of the roller necessary for fin pass forming.

Figure 4:
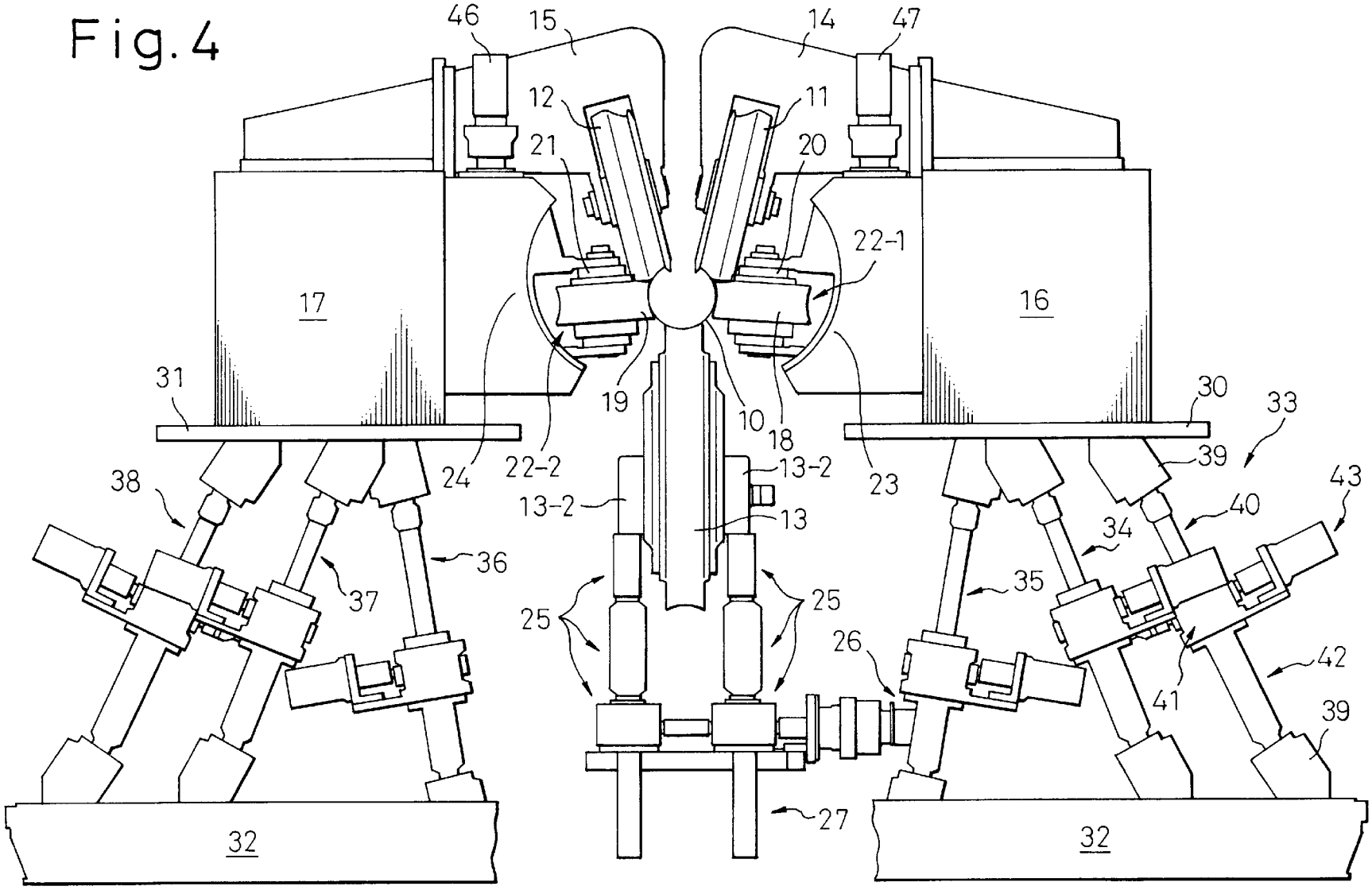
FIG. 4 is a front view showing an arrangement of the fin pass forming apparatus of the present invention.

FIG. 4 is a front view of the fin pass forming roller stand of the fin pass forming device of the present invention.

A pair of fin rollers 11, 12 are supported by L-shaped fin roller supporting members 14, 15 while the rotary shafts of the fin rollers 11, 12 are interposed in the gate type L-shaped fin roller supporting members. End portions of these L-shaped fin roller supporting members are respectively fixed to roller supports 16, 17. Positions of the fin rollers 11, 12 can be freely adjusted in the vertical and the traverse direction with respect to the edge ends of a steel pipe to be formed when the above roller supports are oscillated. Therefore, it is possible to adjust the positions of the fin rollers 11, 12 at arbitrary positions of the steel pipe to be formed. Accordingly, the positions of the fin rollers 11, 12 are changed according to the diameter of the steel pipe to be formed. Consequently, in the case of forming a steel pipe of a specific diameter, on the upstream side of formation, positions of the fin rollers 11, 12 are relatively high in the radial direction of the steel pipe to be formed, and an interval between the fin rollers 11, 12 is large. On the other hand, when the steel pipe to be formed is conveyed in accordance with the progress of formation, the diameter of the steel pipe is reduced. Therefore, the height of the steel pipe is lowered on the downstream side of formation, and the interval is reduced.

Immediately below the steel pipe 10 to be formed and the pair of fin rollers, there is provided a lower roller 13 for holding and forming the steel pipe 10 to be formed. This lower roller 13 is supported by bearings 13-2 and connected to a motor 26 via screw jacks 25 interlocked with these bearings 13-2. When the diameter of the steel pipe to be formed is changed, the vertical position of the lower roller 13 is adjusted by the screw jacks 25 attached to the lower portions of the bearings 13-2.

A pair of side rollers 18, 19, which are not driven, are supported by the C-shaped bearing members 20, 21 and rotated round them. Sectorial tooth faces 22-3, 22-4 provided on the sectorial contact members 22-1, 22-2 are arranged in the upper portion of the above bearing members 20, 21. The sectorial tooth faces 22-3, 22-4 are connected to worm shafts 28, 29 provided on the pair of roller supports 16, 17. The worm shafts provided on the worm shaft boxes 23, 24 protruding from the roller supports 16, 17 are meshed with worm gears. When the worm shafts are rotated by the worm gears, the side rollers 18, 19 are moved by the sector gears on arcuate surfaces in accordance with the outer circumferential surface of a steel pipe to be formed. As described above, the side rollers can be adjusted to arbitrary positions in arbitrary directions in the circumferential direction of the steel pipe to be formed. Accordingly, at arbitrary positions, the side rollers can conduct forming on the steel pipe in accordance with the progress of formation of the steel pipe.

International Patent Application Publication No. WO 95/01848 discloses the support structure of a pair of platforms 30, 31 in the lower portions of the roller support members 14, 15 to adjust the positions of the pair of fin rollers and the side rollers 18, 19. The pair of platforms 30, 31 are arranged symmetrically with respect to the pass line of formation. The work side platform 30 and the drive side platform 31 are respectively supported on the base 32 by the six platform position adjusting mechanisms 33, 34, 35, 36, 37, 38 composed of linear actuators. Each platform position adjusting mechanism is composed in such a manner that the hinge portion 39 attached to the lower portion of the platform is connected to the screw jacks 40, 41, and the screw jack stand 42 is attached to the base 32 via the hinge 39. The platform position adjusting mechanisms 34 to 38 have the same structure as that of the platform position adjusting mechanism 33. These six platform position adjusting mechanisms are operated as follows. When the drive motors 43 connected to the screw jacks 40, 41 are driven, the screw jacks 40, 41 are extended and contracted, so that the platforms 30, 31 can be freely oscillated in the six directions of the front, rear, right, left, up and down. Therefore, the platforms 30, 31 can be adjusted to any position and direction required for the formation of a steel pipe. The above platform position adjusting mechanisms are accurately controlled by a computer arranged separately from the pipe forming mill. As a result of the computation conducted by the computer, the positions of the fin rollers 11, 12 and the positions of the side rollers 18, 19 can be controlled via the roller supporting mounts 16, 17, which are held by the platforms, and via the L-shaped arms.

Figures 5A, 5B:
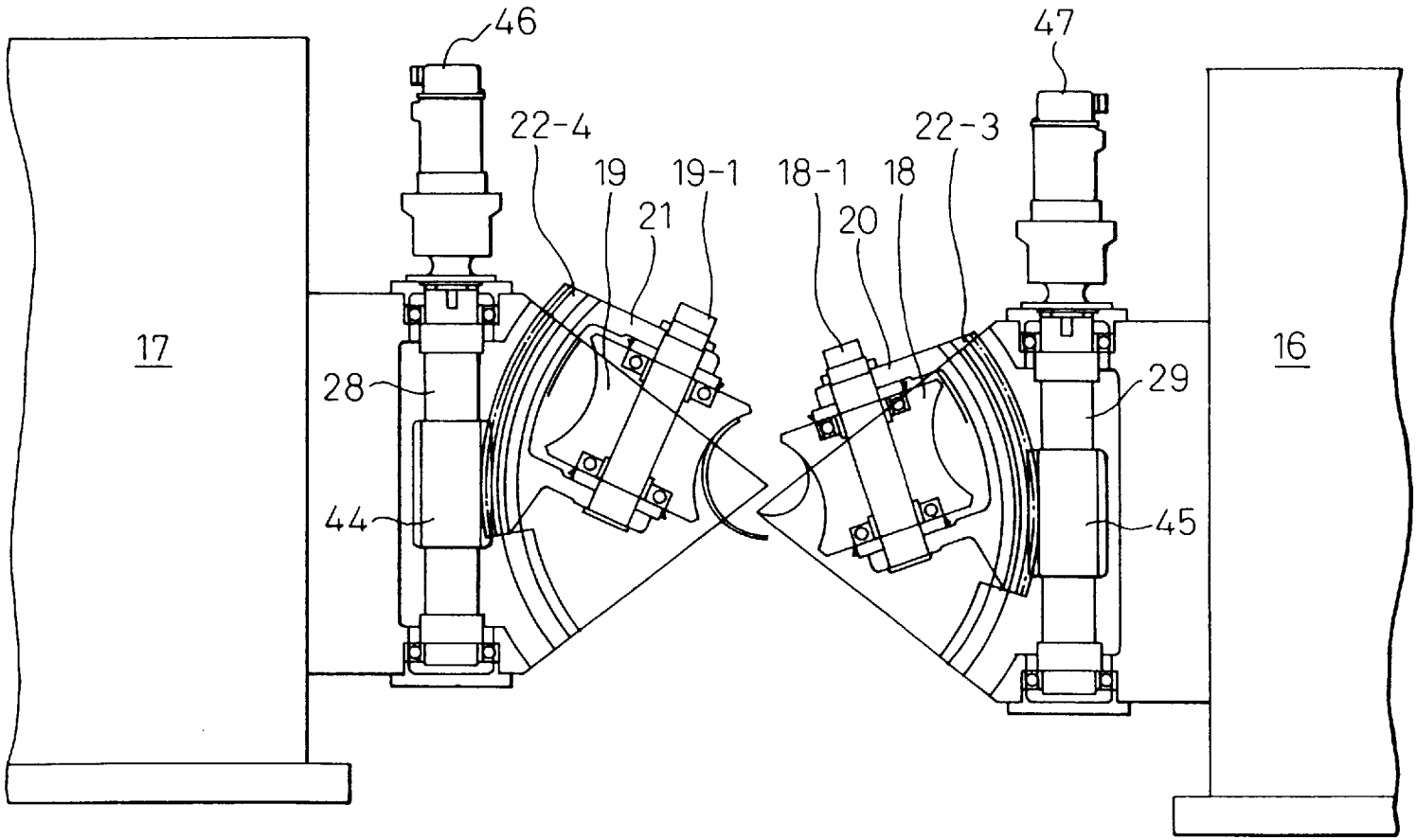
FIG. 5 is a front view showing a side roller driving device of the fin pass forming apparatus of the present invention.

FIG. 5 is a view showing the detail of the mechanisms to conduct arcuate movements of the side rollers 18, 19 according to the present invention.

FIG. 5(*a*) is a view showing an example in which a large diameter steel pipe is formed, and FIG. 5(*b*) is a view showing an example in which a small diameter steel pipe is formed, wherein the pass line of formation is drawn at the center of FIGS. 5(*a*) and 5(*b*).

A pair of side rollers 18, 19, which are not driven, are supported by the C-shaped bearing members 20, 21 and rotated round them. Sectorial tooth faces 22-3, 22-4 provided on the sectorial contact members 22-1, 22-2 are arranged in the upper portion of the above bearing members. Small shafts 28, 29 are housed in the sectorial members 23, 24 provided in the roller supports 16, 17. Sectorial tooth faces 22-3, 22-4 are meshed with the worm gears 44, 45 attached to the small shafts 28, 29. When the drive motors 46, 47 provided at the ends of the small shafts 28, 29 are driven, the side rollers 18, 19 are moved by the predetermined distances via the sectorial tooth surfaces along the outer circumferential surface of the steel pipe to be formed.

Example 2

Figure 6:
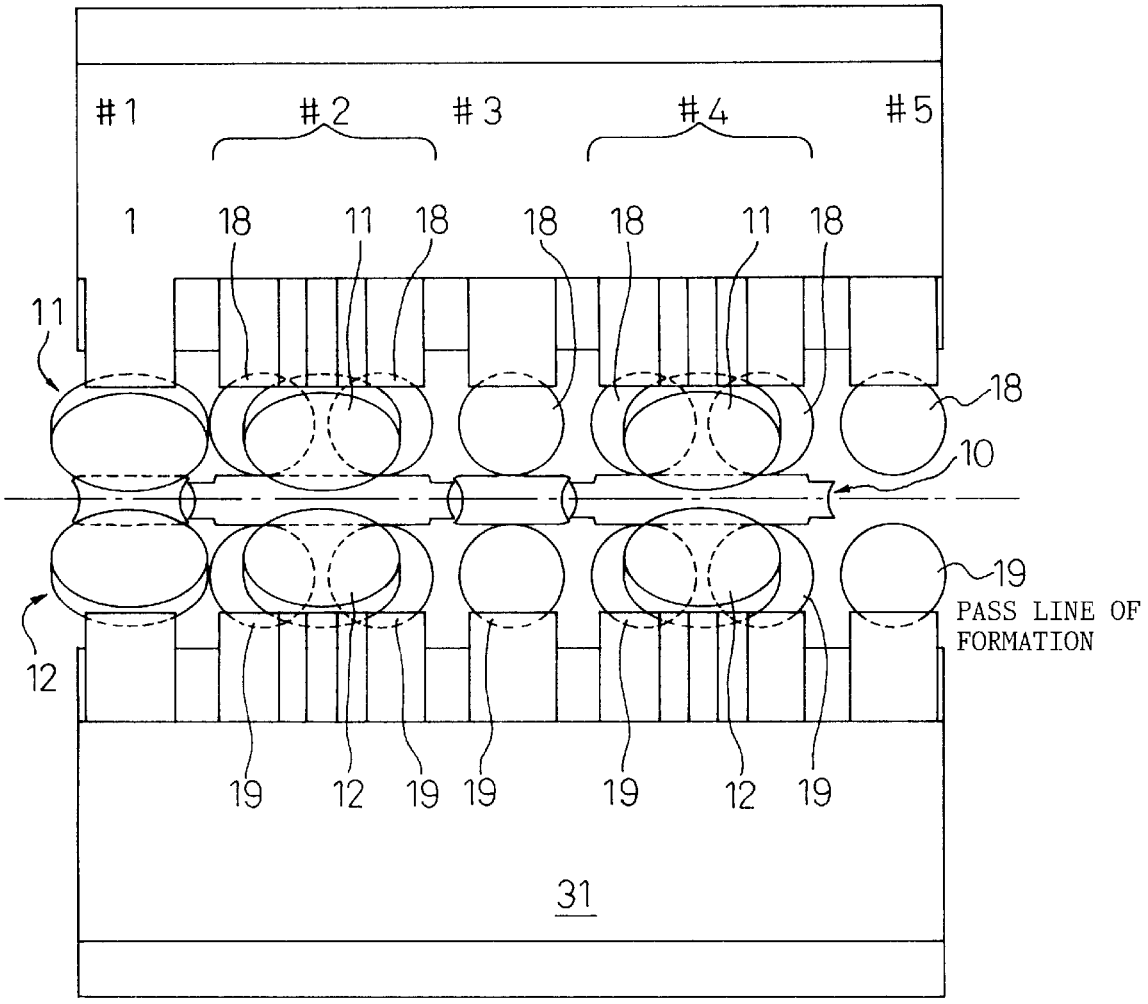
FIG. 6 is a plan view of the fin pass forming apparatus of the present invention.

An example of the train of the fin pass forming devices of the present invention is shown in FIG. 6. The steel pipe 10 to be formed is conveyed on the pass line in the direction of an arrow shown in the drawing.

The train of the fin pass forming devices of the present invention includes: a pair of fin rollers arranged at the upper position in the upstream on the entry side; a lower roller arranged on the section of the center of the fin roller shaft; a pair of fin rollers arranged at the upper position; a lower roller arranged on the section of the center of the fin roller shaft; a pair of side rollers arranged in the front of the fin rollers; a pair of side rollers arranged at the rear of the fin rollers; and side rollers.

Concerning the arrangement of various rollers, the roller stands are arranged in the order of #1, #2, #3, #4 and #5 roller stands. In this arrangement, #1 roller stand includes: a pair of fin rollers 11, 12 arranged in the traverse direction; and a lower roller not shown in the drawing. Each roller stand #2, #4 includes: a pair of fin rollers 11, 12 arranged in the traverse direction; a lower roller not shown in the drawing; a pair of side rollers 18, 19 arranged in the front of the fin rollers; and a pair of side rollers 18, 19 arranged at the rear of the fin rollers. That is, each roller stand #2, #4 is composed of seven roller groups in total. Next, each roller stand #3, #5 includes a pair of side rollers 18, 19 arranged in the traverse direction. The present invention is characterized in that the roller groups in the roller stands #2, #4 compose a single roller stand and are set on the same platform.

The function of each roller stand is described as follows. The pair of fin rollers and the lower roller, which compose #1 roller stand, guide the edges of a steel pipe to be formed, and at the same time the lower roller holds a lower portion of the steel pipe to be formed, and the end portion of the steel pipe is contacted with the fins of the fin rollers, so that the steel pipe conveyed in the longitudinal direction is formed into a substantial circle. The pair of fin rollers, the lower roller and the two pairs of side rollers, which compose each of #2 and #4 roller stand, are integrated into one body and hold the circumference of the steel pipe to be formed. In addition to that, the above integrated rollers conduct drawing, so that the roundness of the steel pipe to be formed can be enhanced. Further, in each roller stand #3, #5, drawing is conducted only by the side rollers on the circumference of the steel pipe including the edge portions, so that the roundness of the steel pipe can be ensured. Immediately after #5 roller stand, the sectional shape of the steel pipe to be formed is finished to an accurate circle, and then the steel pipe to be formed is conveyed to the next process of edge welding.

In the fin pass forming apparatus of the present invention composed in the above manner, the order of the arrangement of the roller stands is not limited to the above specific example. The order of the arrangement of the roller stands may be arbitrarily determined in accordance with the circumstances of the production line.

Example 3

Figure 7:
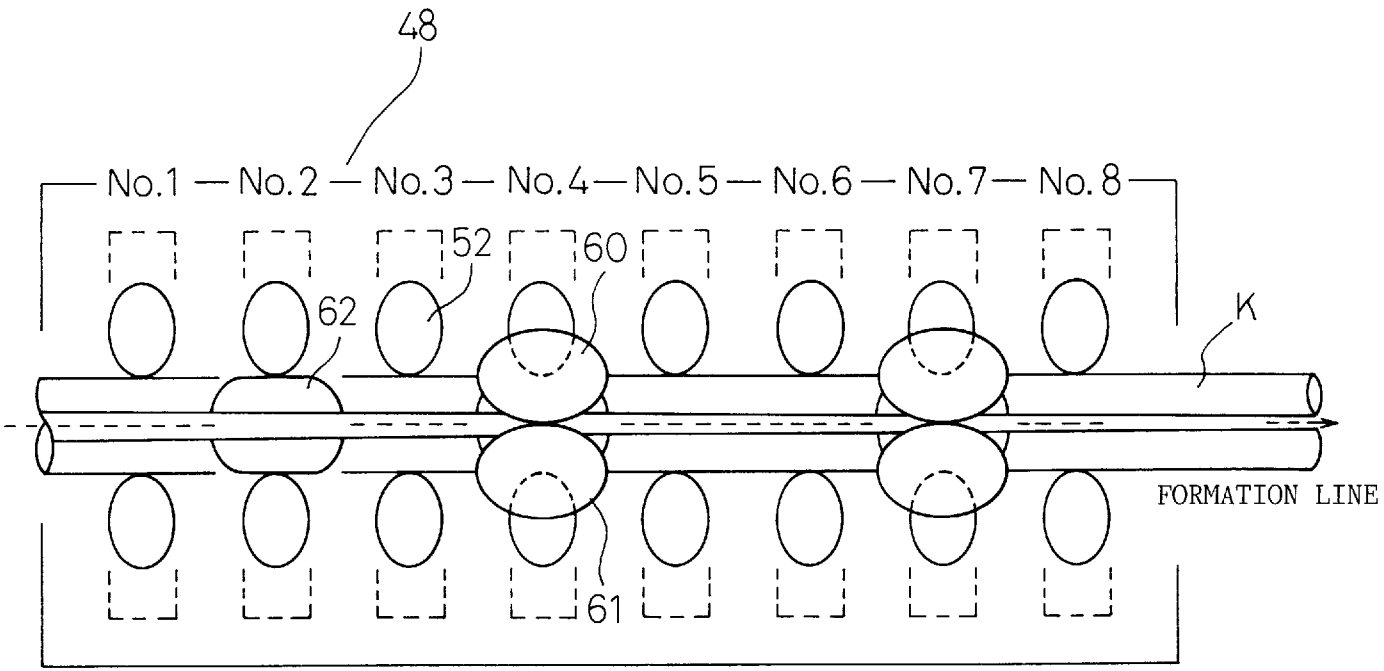
FIG. 7 is a plan view showing an outline of the arrangement of the roller device available for forming seam welded steel pipes of a plurality of sizes of the present invention.
Figure 8:
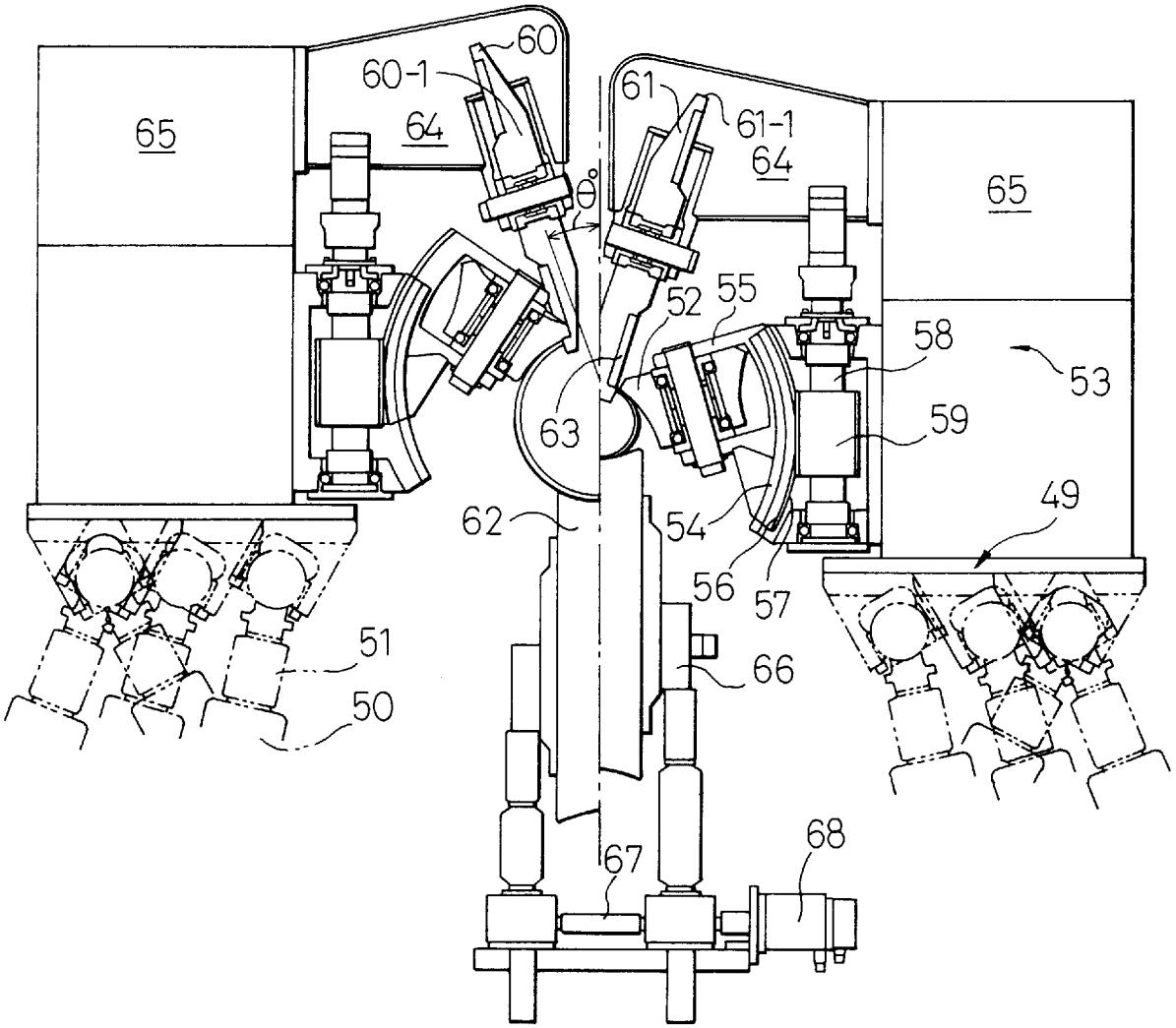
FIG. 8 is a front view showing an outline of the arrangement of the roller device of the pipe mill available for forming seam welded steel pipes of a plurality of sizes of the present invention.
Figure 9:
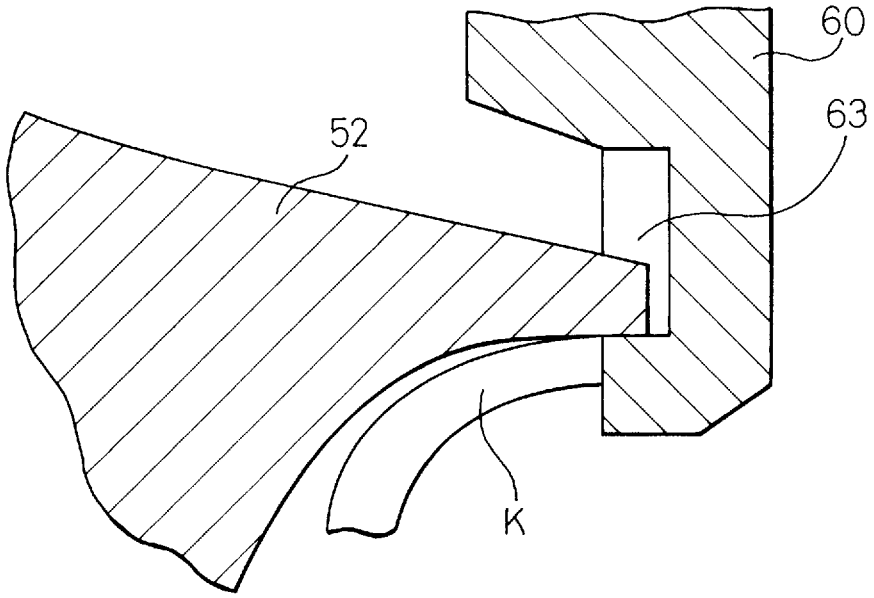
FIG. 9 is an enlarged view showing the detail of a contact point of the side roller with the fin pass roller in the roller device of the pipe mill available for forming seam welded steel pipes of a plurality of sizes of the present invention.

FIG. 7 is an arrangement view showing an example of the roller devices of a pipe mill available for forming seam welded steel pipes of a plurality of sizes of the present invention. FIG. 8 is a front view of the roller devices.

In the cluster mill 48, a plurality of sets of cluster forming rollers (side rollers) are supported as follows. In order to support groups of rollers in which a plurality of cluster rollers are continuously arranged, a pair of platforms 49 are arranged symmetrically with respect to the forming pass line. On each platform 49, a plurality of forming roller stands of No. 1 to No. 8 are arranged. The pair of platforms 49 are supported on the bases (not shown in the drawing) by a plurality of pairs of jacks 50 and jack screw covers 51 which function as links and linear actuators. When these links are extended and contracted, the postures of the pair of platforms are controlled, so that the positions of the side rollers can be adjusted with respect to the steel pipe to be formed (shown in International Patent Application Publication WO 95/01848).

As described above, on each platform 49, a pair of side roller supports 53 for supporting the side roller group 52 (not driven) are arranged. The pair of side roller supports 53 can be freely oscillated in accordance with the movement of each platform 49. On the other hand, in order to make the group of side rollers 52 conduct an arcuate motion round the steel pipe K to be formed, a roller holding mount (not shown) fixed to the side roller supports 53 is formed in such a manner that an inner surface of the roller holding mount in the lateral direction forms a cylindrical mount surface 54 in the vertical direction. In an upper portion of the C-shaped bearing member 55 for supporting the group of side rollers 52, there is provided a sectorial contact member 56 which comes into contact with the cylindrical mount surface 54. Further, in an upper surface of the contact member 56, there is provided a worm wheel 57. Therefore, the worm wheel 57 is meshed with a worm gear 59 mounted on the worm shaft 58 arranged vertically close to the side roller support 53. When the worm shaft 58 is rotated, the bearing member 55 of the group of side rollers 52 conducts an arcuate motion, so that the contact position of the roller surface of the group of side rollers 52 can be changed in the width direction with respect to the steel pipe to be formed.

A radius of curvature of each roller surface of the group of side rollers 52 is determined in such a manner that a portion or all of the sectional curve of the surface is composed of an involute previously determined so that it can contain a predetermined curved surface of the strip to be formed into a steel pipe of various outer diameters in the forming region. In this case, the radius of curvature of the surface is designed to contain all curved surfaces necessary for the formation of steel pipes, and the radius of curvature is also designed to increase as it comes from the lower side to the upper side of the roller. Accordingly, irrespective of the size of the steel pipe to be formed, it is possible to freely select a radius of curvature of the curved surface of the roller necessary for fin pass forming. Consequently, in the formation of the large diameter steel pipe, a portion on the lower side of the roller, the radius of curvature of which is small, is exclusively applied, and in the formation of the small diameter steel pipe, a portion on the upper side of the roller, the radius of curvature of which is large, is exclusively applied. Accordingly, even if the forming roller is the same, it is possible to form steel pipes of various diameters.

As illustrated in the view of the line arrangement of FIG. 7, at least one pair of fin rollers are arranged. In this example, the fin rollers are arranged in No. 4 and No. 7 roller stands. As illustrated in FIG. 8, each fin roller is split into two rollers, one is a fin roller 60 on the work side and the other is a fin roller 61 on the drive side. The fin roller of the present invention is made in such a manner that a conventional fin roller is split into two rollers in the flow direction of the steel pipe K to be formed when the view is taken from the front side. The thus obtained two rollers are symmetrically arranged with respect the flow direction of the steel pipe K to be formed. On the innermost sides of the respective fin rollers, there are provided fins 60-1 and 61-1. The above fin rollers are arranged being inclined by an angle θ° with respect to a line perpendicular to the flow direction of the steel pipe to be formed. Positions of these fin rollers can be adjusted in the vertical and the transverse direction with respect to the center of the steel pipe by a fin roller moving device described later. Accordingly, when the steel pipe to be formed is conveyed in the longitudinal direction, these fin rollers are capable of coming into contact with arbitrary positions of the edges on both sides of the steel pipe in the pipe width direction. When the fin rollers are contacted with the edge portions of the steel pipe to be formed, it is possible to conduct forming on the edge portions.

Further, on the inside of the fin 60-1, 61-1 of the fin roller, there is provided a recess 63 into which an end portion of the side roller 52 can be inserted while it exceeds an end of the steel pipe to be formed. Due to the foregoing, the end of the steel pipe to be formed can be positively formed by the fin of the fin roller, and further the edge portion of the steel pipe to be formed can be positively formed into an ellipse by the side roller 52.

A pair of fin rollers 60, 61 are supported by L-shaped fin roller supporting members 64 while the rotary shafts of the fin rollers 60, 61 are interposed in the gate type L-shaped fin roller supporting members. End portions of these L-shaped fin roller supporting members are respectively fixed to roller supports 65. Positions of the fin rollers 60, 61 can be freely adjusted in the vertical and the traverse direction with respect to the edge ends of a steel pipe to be formed when the above roller supports are oscillated. Therefore, it is possible to adjust the positions of the fin rollers 60, 61 at arbitrary positions of the steel pipe to be formed. Accordingly, the positions of the fin rollers 60, 61 are changed according to the diameter of the steel pipe to be formed. Consequently, in the case of forming a steel pipe of a specific diameter, on the upstream side of formation, positions of the fin rollers are relatively high in the radial direction of the steel pipe to be formed, and an interval between the fin rollers is large. On the other hand, when the steel pipe to be formed is conveyed in accordance with the progress of formation, the diameter of the steel pipe is reduced. Therefore, the height of the steel pipe is lowered on the downstream side of formation, and the interval is reduced.

Immediately below the pair of fin rollers and the steel pipe K to be formed, the lower roller 62 to support and convey the steel pipe K to be formed is arranged. This lower roller is supported by the bearing 66 and connected to the counter shaft 67 via the jack 50 linked with this bearing 66. The counter shaft 67 is driven by the drive motor 68 for driving the lower roller at a necessary rotational speed. When the diameter of the steel pipe to be formed is changed, the position of the lower roller 62 is vertically adjusted by the jack 50 connected to the counter shaft 67.

In this connection, the platform position adjusting mechanism is controlled by a computer arranged separately from the fin pass forming apparatus, so that the platform position can be accurately adjusted. As a result of the above position adjustment, it is possible to control the positions of the platform, roller support held by each platform, fin roller held by the L-shaped arm, and side roller.

INDUSTRIAL AVAILABILITY

As explained above, when the fin pass forming apparatus of the present invention is adopted, it is possible to obtain a steel pipe, the formation accuracy and roundness of which is remarkably high, as compared with a conventional fin pass forming apparatus in which the fin pass rollers, side rollers and lower rollers are arranged on the same section in the flow direction of the steel pipe to be formed, because the formation of the steel pipe is conducted according to the apparatus of the present invention as follows. The fin pass roller is split in two rollers, one is a roller on the work side and the other is a roller on the drive side. Further, a plurality of side rollers come into contact with arbitrary positions of the steel pipe to be formed in arbitrary directions in the circumferential direction of the steel pipe. Accordingly, it is possible to form the steel pipe while the fin rollers and the side rollers are respectively positioned on a section perpendicular to the flow direction of the steel pipe. Accordingly, it is possible to obtain a steel pipe of high formation accuracy, the roundness of which is remarkably high.

Surfaces of the fin pass rollers, lower rollers and a plurality of rollers of the fin pass forming apparatus of the present invention are formed in such a manner that a portion or all of the sectional curve on each roller surface is composed of an involute previously determined to contain each curved surface of the strip to be formed into steel pipes of various diameters in the forming region. Accordingly, it is possible for the forming rollers to follow any sectional shape of the strip to be formed into a steel pipe. Further, irrespective of a change in the diameter of the steel pipe to be formed, it is possible for a single set of forming rollers to conduct the formation of a steel pipe. Therefore, the fin pass forming apparatus of the present invention can provide great advantages.

In the roller device of the pipe mill available for forming seam welded steel pipes of a plurality of sizes of the present invention, the order of the arrangement of the roller stands is not limited to the above specific example. The order of the arrangement of the roller stands may be arbitrarily determined in accordance with the circumstances of the production line, and the elliptical formation and the edge formation can be quickly performed by the same apparatus on the same production line, and further the steel pipe can be formed with high accuracy, and furthermore the equipment investment can be greatly reduced.

DESCRIPTION OF THE REFERENCE NUMERALS

1 . . . Breakdown section
2 . . . Fin pass section
3 . . . Welding section
4 . . . Shape straightening section
6 . . . Upper roller
7 . . . Fin
8 . . . Lower roller
9 . . . Side roller
10 . . . Seam welded steel pipe
11 . . . Fin roller on the drive side
11-1 . . . Fin
11-2 . . . Fin roller surface on the drive side
12 . . . Fin roller on the work side
12-1 . . . Fin
12-2 . . . Fin roller surface on the work side
13 . . . Lower roller
13-1, 13-2 . . . Lower roller surfaces
14, 15 . . . L-shaped fin roller support members
16, 17 . . . Roller supports
18 . . . Side roller
18-1 . . . Side roller shaft
19 . . . Side roller
19-1 . . . Side roller shaft
20, 21 . . . C-shaped bearings for the side rollers
22-1, 22-2 . . . Sectorial contact members
22-3, 22-4 . . . Sectorial tooth surfaces
23, 24 . . . Worm shaft boxes
25 . . . Screw jack
26 . . . Motor
27 . . . Hydraulic cylinder for elevating the lower roller
28, 29 . . . Worm shafts
30, 31 . . . Platforms
32 . . . Base
33 to 38 . . . Platform position adjusting mechanisms

39 . . . Hinge portion
40, 41 . . . Screw jacks
42 . . . Screw jack stands
43 . . . Drive motor
44, 45 . . . Worm gears
46, 47 . . . Motors for rotating small shafts
48 . . . Cluster mill
49 . . . Platform
50 . . . Jack
51 . . . Jack screw cover
52 . . . Side roller
53 . . . Side roller support
54 . . . Cylindrical mount surface
55 . . . Bearing member
56 . . . Contact member
57 . . . Worm wheel
58 . . . Worm shaft
59 . . . Worm gear
60 . . . Fin roller on the work side
60-1 . . . Fin roller on the work side
61 . . . Fin roller on the drive side
61-1 . . . Fin roller on the drive side
62 . . . Lower roller
63 . . . Fin recess portion
64 . . . Fin roller support member
65 . . . Roller support
66 . . . Lower roller bearing
67 . . . Counter shaft
68 . . . Motor for elevating the lower roller
K . . . Steel pipe to be formed

I claim:

1. A roller device for simultaneous elliptical and edge forming of seam welded steel pipes of a plurality of sizes comprising a cluster mill composed of a plurality of pairs of side rollers and a plurality of lower rollers, wherein at least one roller stand having fin rollers is arranged in a group of roller stands having the plurality of pairs of side rollers, and the roller stand having the fin rollers arranged in the cluster mill including;

a pair of fin rollers split into work and drive sides both being inclined with respect to a line perpendicular to a flow direction of the steel pipe to be formed, not less than one pair of side rollers for coming into contact with a steel pipe to be formed, in arbitrary directions or at arbitrary positions in a circumferential direction of the steel pipe to be formed, the side rollers being respectively arranged on each section perpendicular to the flow direction of the steel pipe to be formed for conducting fin pass forming, and at least one lower roller for supporting and forming the steel pipe to be formed, a section of a surface of each fin roller, side roller and lower roller is constructed such that a portion or all of a sectional curve of each roller surface corresponds to a sectional curve composed of an involute previously determined so that the involute includes each curved surface of the steel pipes to be formed of various outer diameters in a selected forming region.

2. A roller device for forming seam welded steel pipes of a plurality of sizes according to claim 1, wherein fin portions of the pair of fin rollers have a recess portion receiving front end portions of a respective side roller, said front end portions having a longitudinal face parallel to the flow direction of the steel pipe, for conducting an elliptical forming of edge portions of the steel pipe to be formed.

3. A fin pass forming apparatus for simultaneous elliptical and edge forming of seam welded steel pipes comprising: a pair of fin rollers split into work and drive sides both being equally inclined with respect to a line perpendicular to a flow direction of the steel pipe to be formed, not less than one pair of side rollers for coming into contact with the steel pipe to be formed, in arbitrary directions or at arbitrary positions in a circumferential direction of the steel pipe to be formed, the side rollers being respectively arranged on each section perpendicular to the flow direction of the steel pipe to be formed for conducting fin pass forming, and at least one lower roller for supporting and forming the steel pipe to be formed, a section of a surface of each fin roller, side roller and lower roller is constructed such that a portion or all of a sectional curve of each roller surface corresponds to a sectional curve composed of an involute previously determined so that the involute includes each curved surface of the steel pipes to be formed of various outer diameters in a selected forming region; said apparatus further comprising a cluster mill composed of a plurality of pairs of side rollers and a plurality of lower rollers, wherein at least one roller stand having fin rollers is arranged in a group of roller stands having the plurality of pairs of side rollers.

4. A train of fin pass forming devices for forming seam welded steel pipes according to claim 3, composed of at least one single roller stand, the single roller stand comprising a pair of fin rollers; not less than one pair of side rollers; and a plurality of lower rollers.

5. A roller device for forming seam welded steel pipes of a plurality of sizes according to claim 3, wherein fin portions of the pair of fin rollers have a recess portion receiving front end portions of a respective side roller, said front end portions having a longitudinal face parallel to the flow direction of the steel pipe, for conducting an elliptical forming of edge portions of the steel pipe to be formed.

* * * * *